US010172455B2

(12) United States Patent
Arthur

(10) Patent No.: US 10,172,455 B2
(45) Date of Patent: Jan. 8, 2019

(54) DUAL-SIDED STORAGE BIN

(71) Applicant: Williams-Sonoma, Inc., San Francisco, CA (US)

(72) Inventor: Emily S. Arthur, Los Angeles, CA (US)

(73) Assignee: Williams-Sonoma, Inc., San Francisco, CA (US)

( * ) Notice: Subject to any disclaimer, the term of this patent is extended or adjusted under 35 U.S.C. 154(b) by 0 days.

(21) Appl. No.: 15/438,062

(22) Filed: Feb. 21, 2017

(65) Prior Publication Data

US 2017/0238706 A1 Aug. 24, 2017

Related U.S. Application Data

(60) Provisional application No. 62/297,216, filed on Feb. 19, 2016.

(51) Int. Cl.

| | |
|---|---|
| ***A47B 83/00*** | (2006.01) |
| ***A47B 83/04*** | (2006.01) |
| ***A47B 21/06*** | (2006.01) |
| ***A47B 87/00*** | (2006.01) |

(52) U.S. Cl.

CPC ..... *A47B 83/001* (2013.01); *A47B 21/06* (2013.01); *A47B 83/045* (2013.01); *A47B 87/007* (2013.01); *A47B 2200/0066* (2013.01)

(58) Field of Classification Search

CPC ..... A47B 83/001; A47B 83/045; A47B 5/00
USPC ..... 108/50.01, 50.02, 50.11, 25, 26
See application file for complete search history.

(56) References Cited

U.S. PATENT DOCUMENTS

| | | | | | |
|---|---|---|---|---|---|
| 5,094,174 | A * | 3/1992 | Grund | A47B 17/033 | 108/153.1 |
| 5,183,319 | A * | 2/1993 | Pearson | A47B 17/033 | 248/188.4 |
| 5,226,705 | A * | 7/1993 | Rorke | A47B 21/06 | 108/50.02 |
| 5,899,025 | A * | 5/1999 | Casey | E04B 2/7453 | 108/50.02 |
| 5,975,657 | A * | 11/1999 | LaCour | A47B 83/001 | 312/196 |
| 6,267,064 | B1 * | 7/2001 | Ostertag | A47B 13/021 | 108/108 |
| 6,283,043 | B1 * | 9/2001 | Stern | A47B 13/06 | 108/50.02 |
| 6,415,723 | B1 * | 7/2002 | Kopish | A47B 3/0815 | 108/128 |
| 6,448,498 | B1 * | 9/2002 | King | A47B 21/06 | 108/50.02 |
| 7,077,068 | B1 * | 7/2006 | Agee | A47B 9/00 | 108/147 |
| 8,186,281 | B2 * | 5/2012 | Bastian | A47B 21/06 | 108/50.02 |
| 8,196,526 | B2 * | 6/2012 | Rheault | A47B 13/10 | 108/50.01 |

(Continued)

*Primary Examiner* — Jose V Chen
(74) *Attorney, Agent, or Firm* — Cook Alex Ltd.; R. Blake Johnston

(57) ABSTRACT

A dual-sided storage bin includes a housing containing first and second storage recesses with access openings on opposite sides of the storage bin. The back wall of each storage recess forms a utility surface for the opposite side of the storage bin. As a result, individuals on each side of the storage bin are provided with both a storage recess and a utility surface.

18 Claims, 8 Drawing Sheets

(56) References Cited

U.S. PATENT DOCUMENTS

| | | | | |
|---|---|---|---|---|
| 9,215,924 | B2 * | 12/2015 | Seefeldt | A47B 21/06 |
| 9,907,398 | B2 * | 3/2018 | Dame | A47B 83/045 |
| 2003/0136312 | A1 * | 7/2003 | Guimil | A47B 21/00<br>108/50.02 |
| 2005/0189851 | A1 * | 9/2005 | Martin | A47B 21/00<br>312/196 |
| 2005/0268825 | A1 * | 12/2005 | Mueller | A47B 21/00<br>108/60 |
| 2007/0181044 | A1 * | 8/2007 | Baloga | A47B 21/00<br>108/50.01 |
| 2009/0293773 | A1 * | 12/2009 | Miller | A47B 21/00<br>108/28 |
| 2014/0182229 | A1 * | 7/2014 | Dame | A47B 83/001<br>52/582.1 |
| 2014/0261100 | A1 * | 9/2014 | Henriott | A47B 13/02<br>108/50.02 |
| 2016/0213145 | A1 * | 7/2016 | Johnson | A47B 83/001 |

* cited by examiner

DUAL-SIDED STORAGE BIN

CLAIM OF PRIORITY

This application claims the benefit of U.S. Provisional Application No. 62/297,216, filed Feb. 19, 2016, the contents of which are hereby incorporated by reference.

FIELD OF THE INVENTION

The present invention relates generally to furniture and, more particularly, to a dual-sided storage bin.

SUMMARY

There are several aspects of the present subject matter which may be embodied separately or together in the devices and systems described and claimed below. These aspects may be employed alone or in combination with other aspects of the subject matter described herein, and the description of these aspects together is not intended to preclude the use of these aspects separately or the claiming of such aspects separately or in different combinations as set forth in the claims appended hereto.

In one aspect, a dual-sided storage bin includes a top wall, a bottom wall opposing the top wall, a first end wall and a second end wall. The first and second end walls extend between the top and bottom walls so that a housing is defined having a first side and a second. A divider positioned between the top and bottom walls. A first back wall is positioned between the first end wall and the divider so that a second storage recess is defined having an access opening facing the second side of the housing. The first back wall includes a first utility surface facing the first side of the housing. A second back wall is positioned between the second end wall and the divider so that a first storage recess is defined having an access opening facing the first side of the housing. The second back wall includes a second utility surface facing the second side of the housing.

In another aspect, a workstation includes a work surface with a dual-sided storage bin positioned on the work surface. The dual-sided storage bin includes a first side having a first utility surface and a first storage recess and a second side including a second utility surface and a second storage recess. The first utility surface is formed from a first back wall of the second storage recess and the second utility surface is formed from a second back wall of the first storage recess. A support bracket supports the dual-sided storage bin on the work surface.

In still another aspect, a dual-sided storage bin includes a first side having a first utility surface and a first storage recess and a second side including a second utility surface and a second storage recess where the first utility surface is formed from a first back wall of the second storage recess and the second utility surface is formed from a second back wall of the first storage recess.

DETAILED DESCRIPTION OF EMBODIMENTS

Figure 1:
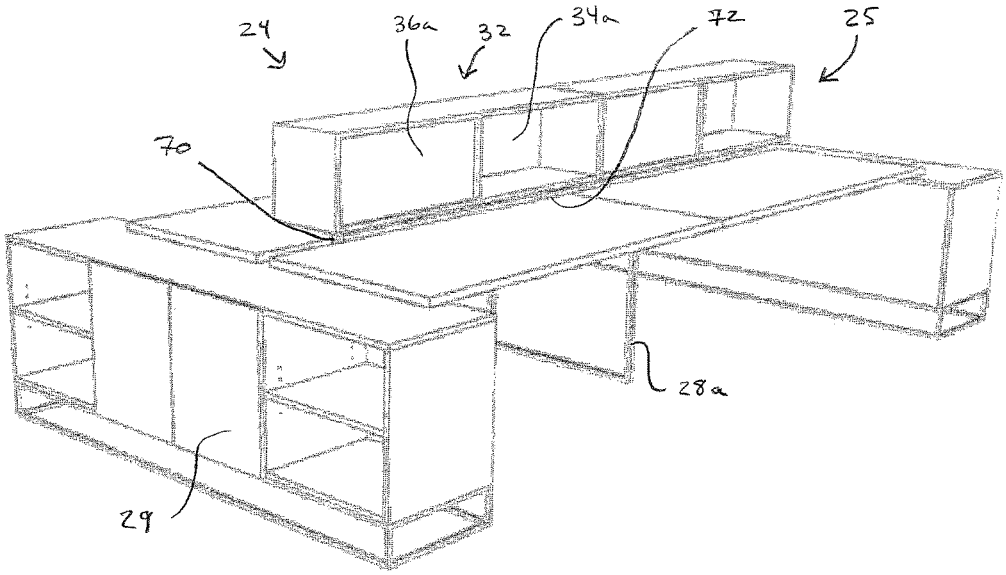
FIG. 1 is a perspective view of a pair of abutting workstations, each including an embodiment of the storage bin of the present invention.
Figure 2:
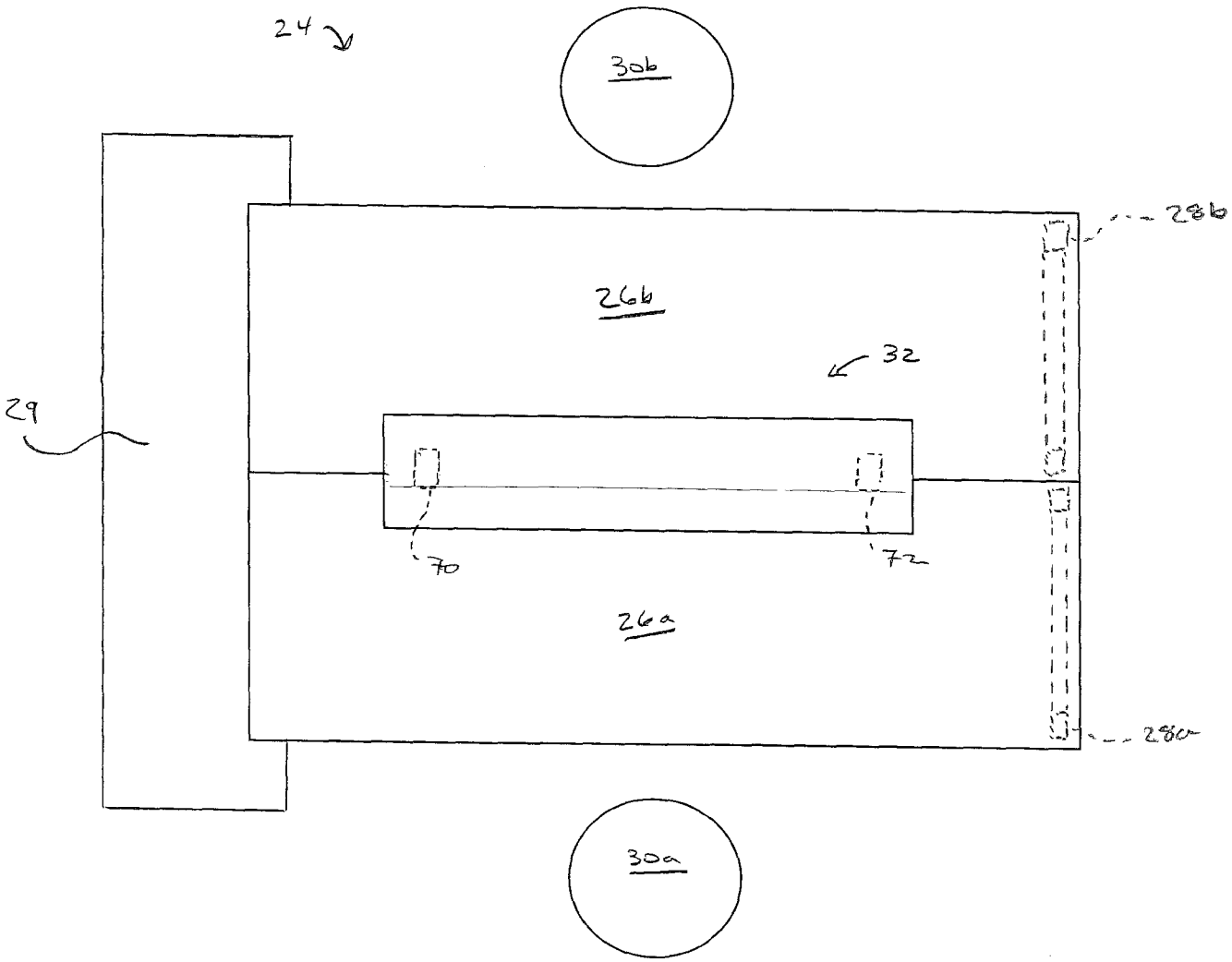
FIG. 2 is a top plan view of one of the workstations and storage bin of FIG. 1 with seating added.

A workstation including an embodiment of the storage bin of the present invention is indicated in general at 24 in FIGS. 1 and 2. A second abutting workstation of similar construction is indicated in general at 25. The workstation 24 includes a pair of desk tops or work surfaces 26*a* and 26*b*, each supported by legs 28*a* and 28*b* on one side and a shelving unit 29 on the other. While two adjoining work surfaces are illustrated for workstation 24, the workstation may feature a single integrated work surface that is large enough for two individuals to share. As illustrated in FIG. 2, the workstation may be provided with a pair of seats 30*a* and 30*b* so that individuals using the work station are oriented so as to face one another. As will be clear from the following, the invention may alternatively be used as or integrated into furniture other than workstations.

A dual-sided storage bin, indicated in general at 32 in FIGS. 1 and 2, is positioned to provide a privacy barrier or divider for the workstation for individuals sitting on each side of the workstation. In addition, the dual-sided storage bin provides each side of the workstation with a storage recess (34*a* in FIG. 1) and a generally vertical utility surface (36*a* in FIG. 1) which, as described below, may have a variety of uses. The side of the storage bin opposite the one shown in FIG. 1 has an identical appearance due to the construction of the storage bin as described below.

Figure 3:
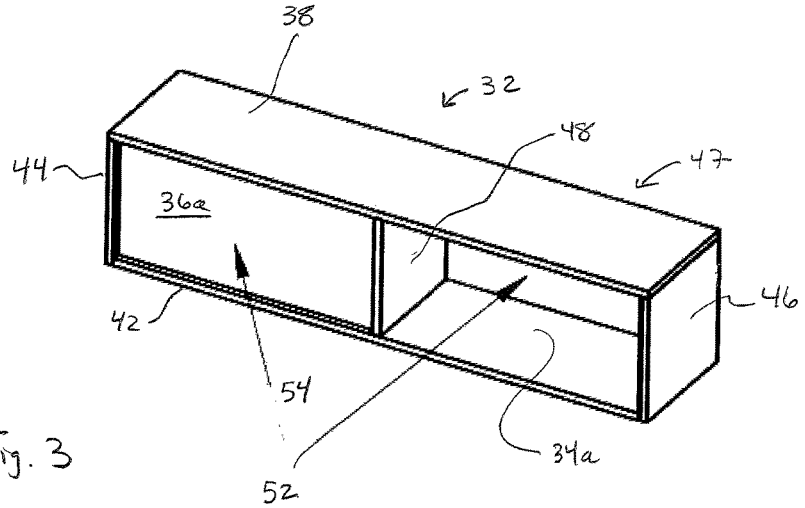
FIG. 3 is an enlarged perspective view of the storage bin of FIGS. 1 and 2.
Figure 4:
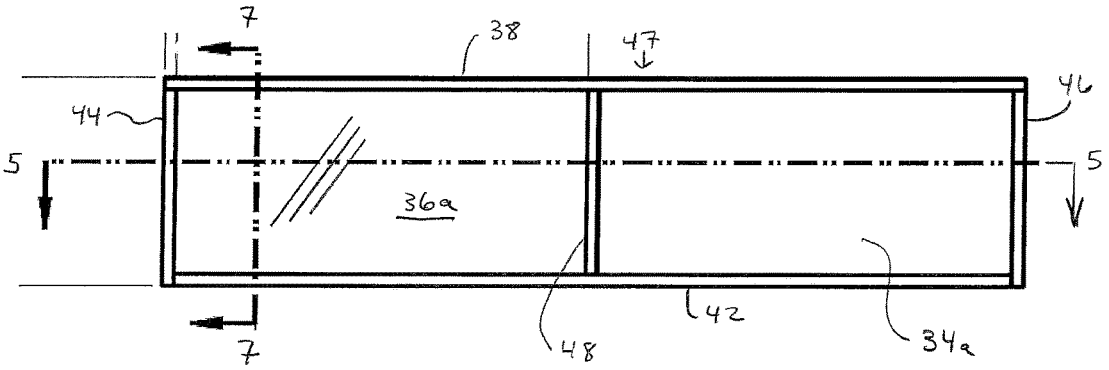
FIG. 4 is a front elevational view of the storage bin of FIG. 3.
Figure 5:
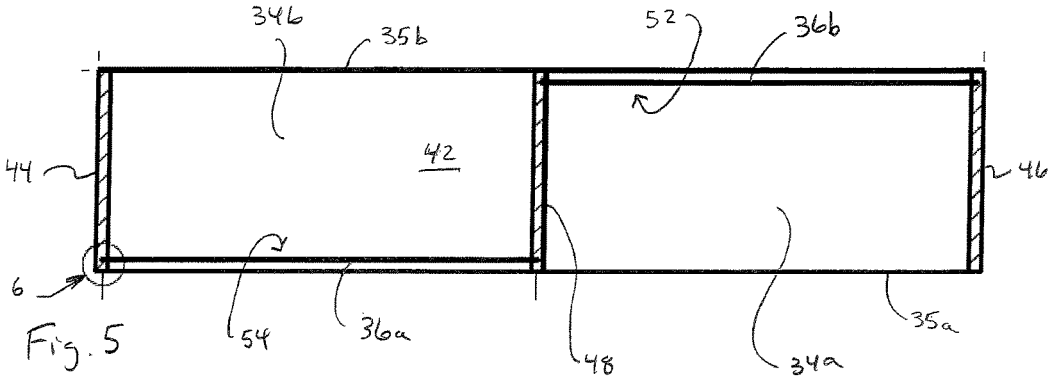
FIG. 5 is a cross sectional view of the storage bin taken along line 5-5 of FIG. 4.

With reference to FIGS. 3-5, the storage bin features a top wall 38, an opposing bottom wall 42 and a pair of opposing end walls 44 and 46 extending between the top and bottom walls so that a housing, indicated in general at 47, is formed. A divider 48 extends between the top and bottom walls. While the top, bottom and end walls and divider are shown as individual panels that are joined (such as by welding, adhesive, fasteners or other fastening arrangements), any combination of these components may be integrally formed from a single piece. In addition, while the divider is shown as extending between the top and bottom walls, it may alternatively, only extend part way between the two components.

As best shown in FIGS. 3 and 5, a first back wall panel 52 forms the back wall of storage recess 34*a* as well as utility surface 36*b* and a second back wall panel 54 forms the back wall of the storage recess 34*b* as well as the utility surface 36*a*. Storage recess 34*a* features an open side forming an access opening 35*a* facing the same direction as utility surface 36*a*, while storage recess 34*b* features and open side forming an access opening 35*b* facing the same direction as utility surface 36*b*. As a result, each individual sitting at the work station has his or her own utility surface and storage recess with access opening.

Figure 6:
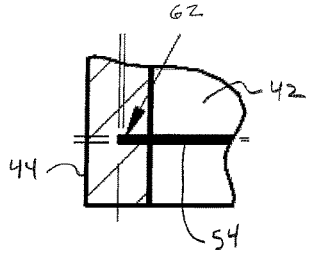
FIG. 6 is an enlarged detail view of the area included in circle 6 of FIG. 5.
Figure 7:
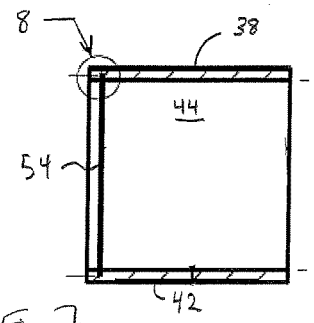
FIG. 7 is a cross sectional view of the storage bin of taken along line 7-7 of FIG. 4.
Figure 8:
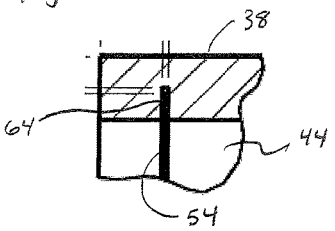
FIG. 8 is an enlarged detail view of the area included in circle 8 of FIG. 7.

With reference to FIGS. 6-8, the back wall panel 54 is secured in position by grooves formed in the top and bottom walls, the divider 48 and the corresponding end wall 44. More specifically, as shown in FIG. 6, an elongated vertical groove 62 extends from the top edge to the bottom edge of end wall 44 and receives the corresponding edge of back wall panel 54. A similar arrangement exists for divider 48. As shown in FIG. 8, an elongated horizontal groove 64 extends from one side edge of top wall 38 to the other and receives the corresponding top edge of back wall panel 54. A similar arrangement exists for the bottom wall 42. Of course alternative fastening arrangements known in the art may be used to secure the back wall panels in place.

As shown in FIGS. 1 and 2, the storage bin is supported on work surfaces 26*a* and 26*b* by support brackets 70 and 72. Enlarged views of the support bracket 70 are provided in FIGS. 9-11. Support bracket 72 features the same construction.

Figure 9:
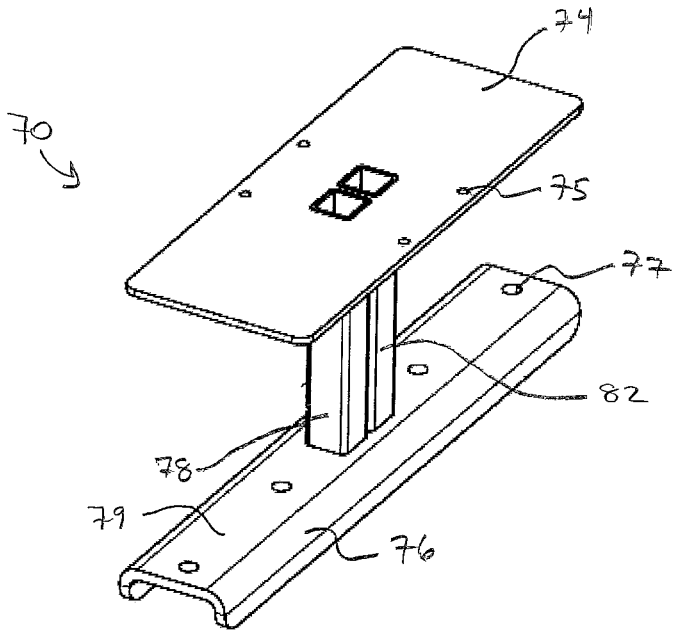
FIG. 9 is an enlarged perspective view of the support bracket of FIG. 4.
Figure 10:
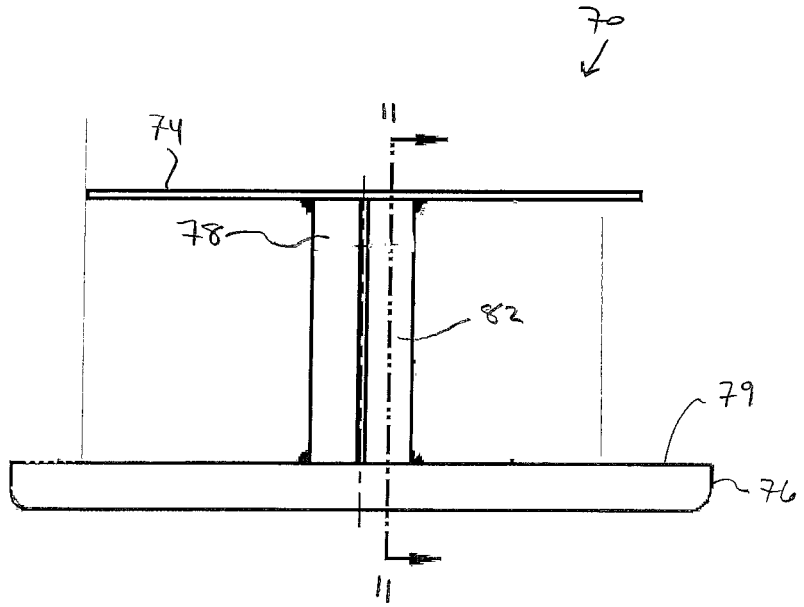
FIG. 10 is a side elevational view of the support bracket of FIG. 9.
Figure 11:
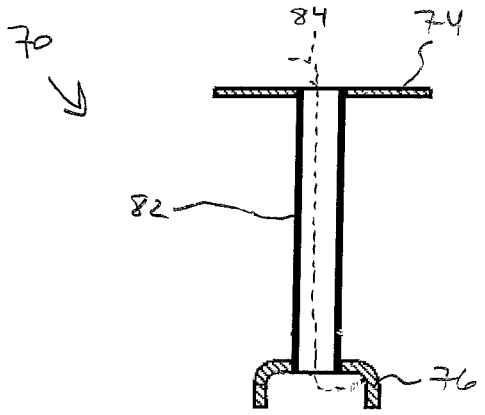
FIG. 11 is a cross sectional view of the support bracket taken along line of 11-11 of FIG. 10.

As shown in FIGS. 9-11, support bracket 70 features a top support plate 74 and a base 76. Base 76 preferably takes the form of a channel to increase the strength and rigidity of the base. Openings 75 and 77 are formed in the top plate and base so that the base may be secured to the undersides of the work surfaces of the workstation (with the top surface 79 of the base abutting the underside of the work surfaces) and the top plate may be secured to the bottom wall of the storage bin. A pair of upright tubes 78 and 82 extend between the base and the top plate and form openings in the top plate and base. As illustrated by dashed line 84 in FIG. 11, the upright tubes 78 and 82 form a passage for running electrical wires and the like up into the storage recess (when a corresponding opening is formed in the bottom wall of the storage bin) for powering electronic devices positioned in the storage recess. The top plate, upright tubes and base are preferably formed by metal and welded together, but other materials and fastening arrangements may be used. Furthermore, each support bracket may alternatively be integrally formed or molded. While square cross sections are illustrated for the upright tubes, any cross section shape may be used and a different number of upright tubes may be used.

Returning to FIG. 5, each back wall panel 52 and 54 is preferably constructed from metal. As a result, a user may post notes upon utility surfaces 36*a* and 36*b* using magnets.

Figure 12:
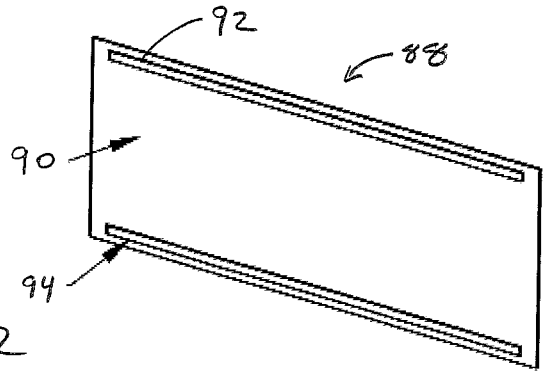
FIG. 12 is a perspective view of a whiteboard insert for use on the storage bin of FIGS. 1-8.
Figure 13:
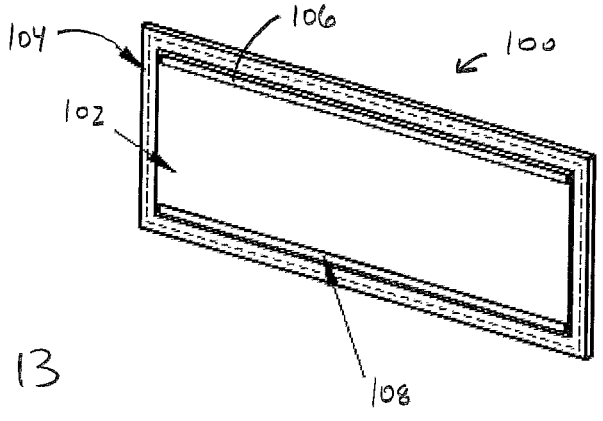
FIG. 13 is a perspective view of a tackable board insert for use on the storage bin of FIGS. 1-8.
Figure 14:
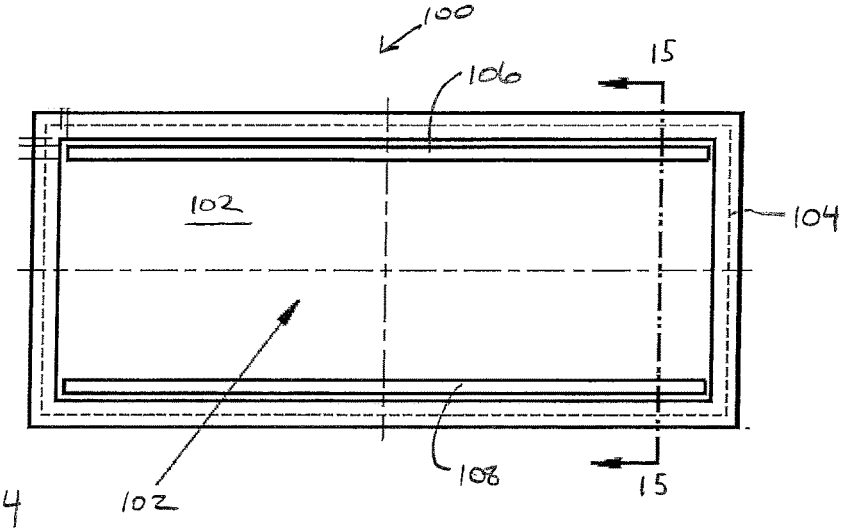
FIG. 14 is a rear elevational view of the tackable board insert of FIG. 13.

In addition, a removable whiteboard insert may be secured to each utility surface. More specifically, with reference to FIG. 12, the whiteboard insert, indicated in general at 88, may be formed from a sheet of material 90 (such as, but not limited to, metal) that is coated with whiteboard paint. Magnetic strips 92 and 94 are secured to the sheet of material 90, such as with adhesive or fasteners. As an example only, magnetic tape may be used to form strips 92 and 94. The whiteboard insert 88 may be placed over a utility surface (36*a* or 36*b* of FIG. 5) with the side having the magnetic strips 92 and 94 facing the utility surface. As a result, the whiteboard insert is secured to the utility surface and a user may make notes on the exposed whiteboard surface (opposite side to the one shown in FIG. 12).

Figure 15:
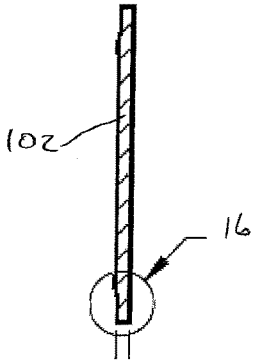
FIG. 15 is a cross sectional view of the tackable board insert taken along lines 15-15 of FIG. 14.
Figure 16:
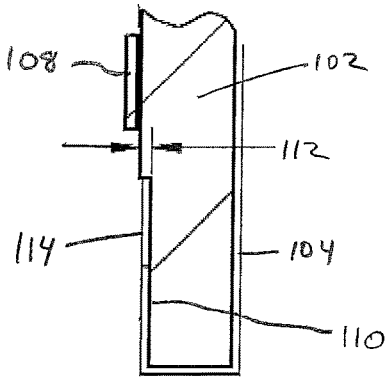
FIG. 16 is an enlarged detail view of the area of circle 16 of FIG. 15.

Turning to FIGS. 13-16, a tackable board insert is indicated in general at 100. The tackable insert is formed from a sheet of material 102 that receives thumbtacks or the like. As examples only, the material may be MICORE board or cork board. The material is covered with fabric 104, and the back side of the insert is provided with magnetic strips 106 and 108. As shown in FIGS. 15 and 16, the peripheral edges of the sheet of material 102 are provided with recesses 110 having a depth generally equal to or greater than the thickness of the fabric covering 104 (as illustrated by arrows 112 of FIG. 16). The edges 114 of the fabric covering 104 are wrapped around and positioned in the recesses so that the magnetic strips 106 and 108 may contact a corresponding utility surface (36*a* or 36*b*) to hold the tackable insert in place on the storage bin. As a result, a user may post messages, etc. on the tackable insert using thumbtacks, pins or the like.

While magnetic mounts are used for the whiteboard and tackable inserts of FIGS. 12-16, it should be noted that alternative arrangements may be used to fasten the inserts to a utility surface (36*a* or 36*b*). This may include, as an example only, hook and loop fasteners (such as VELCRO). Alternatively, the whiteboard or tackable inserts could be permanently attached to the utility surface or could be substituted for the utility panel so as to serve as the back wall of a corresponding storage recess.

Figure 17:
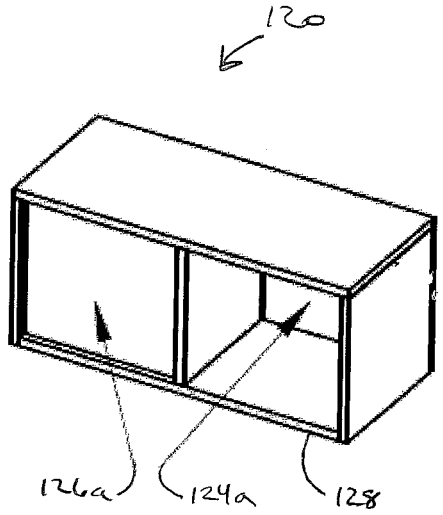
FIG. 17 is a perspective view of a second embodiment of the storage bin of the present invention.
Figure 18:
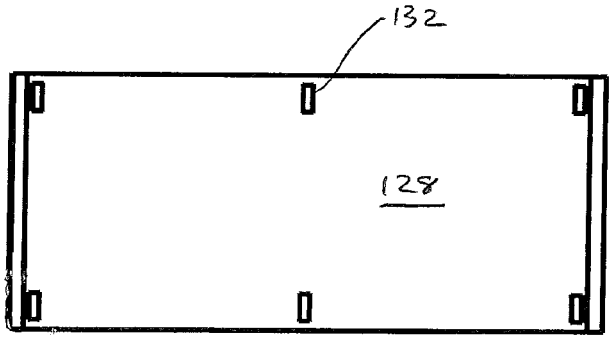
FIG. 18 is a bottom plan view of the storage bin of FIG. 17.

Turning to FIG. 17, an embodiment of the dual-sided storage bin in the form of a bench is indicated in general at 120. The storage bin features the same construction as the storage bin of FIG. 5 with a storage recess and utility surface provided on each side, shown at 124*a* and 126*a*, respectively, for the illustrated side. As illustrated in FIG. 18, the bottom 128 of the bench is provided with feet 132 for supporting the bench on a floor or other surface, such as a desk, table top or workstation work surface. The feet may be constructed from felt, plastic, rubber or any other suitable material known in the art.

While the preferred embodiments of the invention have been shown and described, it will be apparent to those skilled in the art that changes and modifications may be made therein without departing from the spirit of the invention, the scope of which is defined by the following claims.

What is claimed is:

1. A dual-sided storage bin comprising:

a. a top wall, a bottom wall opposing the top wall, a first end wall and a second end wall, said first and second end walls extending between the top and bottom walls so that a housing is defined having a first side and a second side;

b. a divider positioned between the top and bottom walls;

c. a first back wall having a first fastening portion and positioned between the first end wall and the divider so that a second storage recess is defined having an access opening facing the second side of the housing, said first back wall including a first utility surface facing the first side of the housing;

d. a second back wall having a second fastening portion and positioned between the second end wall and the divider so that a first storage recess is defined having an access opening facing the first side of the housing, said second back wall including a second utility surface facing the second side of the housing;

e. an insert including a front side having a markable surface and/or a tackable surface and a back side having a fastener positioned thereon that is configured to selectively and removably engage the first fastening portion or the second fastening portion so that said insert is configured to be selectively and removably mounted on either the first or second utility surface.

2. The dual-sided storage bin of claim 1 wherein the markable surface of the insert includes a whiteboard.

3. The dual-sided storage bin of claim 1 further comprising a support bracket that engages the bottom wall of the housing and is adapted to engage a work surface.

4. The dual-sided storage bin of claim 3 wherein the bottom wall has an opening and wherein the support bracket includes an upright tube with a central passage in communication with the bottom wall opening so that an electrical cord may enter the first or second storage recess.

5. The dual-sided storage bin of claim 1 wherein the bottom wall of the housing is provided with feet for supporting the dual-sided storage bin on a surface.

6. The dual-sided storage bin of claim 1 wherein the divider extends between the top and bottom walls.

7. The dual-sided storage bin of claim 1 wherein the first back wall extends between the first end wall and the divider.

8. The duel-sided storage bin of claim 1 wherein the second back wall extends between the second end wall and the divider.

9. The dual-sided storage bin of claim 1 wherein the fastener of the insert includes a magnet and the first fastening portion of the first back wall includes a first metal portion and the second fastening portion of the second back wall includes a second metal portion so that said insert is configured to be selectively and removably mounted on either the first or second utility surface via magnetic attraction between the magnet and either the first or second metal portion.

10. The dual-sided storage bin of claim 9 wherein the first and second back walls are constructed from metal.

11. A workstation comprising:

a. a work surface;

b. a dual-sided storage bin positioned on the work surface, said dual-sided storage bin including a first side having a first utility surface and a first storage recess and a second side including a second utility surface and a second storage recess where said first utility surface is formed from a first back wall of the second storage recess and said second utility surface is formed from a second back wall of the first storage recess, wherein said first back wall has a first fastening portion and said second back wall has a second fastening portion;

c. a support bracket supporting the dual-sided storage bin on the work surface;

d. an insert including a front side having a markable surface and/or a tackable surface and a back side having a fastener positioned thereon that is configured to selectively and removably engage the first fastening portion or the second fastening portion so that said insert is configured to be selectively and removably mounted on either the first or second utility surface.

12. The workstation of claim 11 wherein the dual-sided storage bin includes a bottom wall having an opening and wherein the support bracket includes an upright tube with a central passage in communication with the bottom wall opening so that an electrical cord may enter the first or second storage recess.

13. The workstation of claim 11 wherein the markable surface of the insert includes a whiteboard.

14. The workstation of claim 11 wherein the dual-sided storage bin includes a housing having a top wall, a bottom wall, a first end wall and a second end wall, said first and second end walls extending between the top and bottom walls, and wherein the dual-sided storage bin includes a dividing wall positioned between the first and second storage recesses.

15. The workstation of claim 14 wherein the divider extends between the top and bottom walls.

16. The workstation of claim 15 wherein the first back wall extends between the first end wall and the divider and the second back wall extends between the second end wall and the divider.

17. The workstation of claim 11 wherein the fastener of the insert includes a magnet and the first fastening portion of the first back wall includes a first metal portion and the second fastening portion of the second back wall includes a second metal portion so that said insert is configured to be selectively and removably mounted on either the first or second utility surface via magnetic attraction between the magnet and either the first or second metal portion.

18. The workstation of claim 17 wherein the first and second back walls are constructed from metal.

* * * * *